United States Patent [19]

Bialczak

[11] 4,306,007

[45] Dec. 15, 1981

[54] PROCESS OF MAKING AND USING FADE-RESISTANT DIAZO MICROFILM

[75] Inventor: Edward C. Bialczak, Guilford, Conn.

[73] Assignee: AM International, Inc., Los Angeles, Calif.

[21] Appl. No.: 118,083

[22] Filed: Feb. 4, 1980

Related U.S. Application Data

[63] Continuation of Ser. No. 885,830, Mar. 13, 1978, abandoned, which is a continuation of Ser. No. 724,357, Sep. 17, 1976, abandoned.

[51] Int. Cl.[3] ..... G03C 5/18

[52] U.S. Cl. ..... 430/8; 430/146; 430/150; 430/157; 430/158; 430/162; 430/168; 430/171

[58] Field of Search ..... 430/157, 158, 162, 171, 430/8, 168, 146, 150

[56] References Cited

U.S. PATENT DOCUMENTS

| | | | |
|---|---|---|---|
| 2,276,151 | 3/1942 | Brandenberger . | |
| 3,311,475 | 3/1967 | Van Loon et al. . | |
| 3,338,713 | 8/1967 | Hendrickx et al. | 430/187 |
| 3,365,293 | 1/1968 | Haefeli et al. | 430/157 |
| 3,498,791 | 3/1970 | Rauhut et al. | 430/174 |
| 3,619,191 | 11/1971 | Desjavlais | 430/163 |

FOREIGN PATENT DOCUMENTS

| | | | |
|---|---|---|---|
| 1256065 | 12/1967 | Fed. Rep. of Germany . | |
| 708151 | 4/1954 | United Kingdom | 430/157 |
| 711390 | 6/1954 | United Kingdom | 430/157 |
| 966258 | 8/1964 | United Kingdom | 430/157 |
| 1001007 | 8/1965 | United Kingdom | 430/157 |
| 1059856 | 2/1967 | United Kingdom . | |
| 1129407 | 10/1968 | United Kingdom | 430/157 |
| 1189537 | 4/1970 | United Kingdom . | |
| 1375346 | 11/1974 | United Kingdom . | |
| 1417221 | 12/1975 | United Kingdom . | |

OTHER PUBLICATIONS

Barba, A., et al., SPSE Symposium on Unconventional Photographic Systems, 10/1964, Paper No. 28, p. 143.

Habib, D., SPSE Symposium on Unconventional Photographic Systems, 2nd Symp., 10/1967, pp. 6–10.

Dinaburg, M.S., "Photosensitive Diazo Cpds and Their Uses", Focal Press, 1964, pp. 140–158.

*Primary Examiner*—Charles L. Bowers, Jr.

*Attorney, Agent, or Firm*—Anthony W. Karambelas; Robert C. Curfiss; Patrick F. Bright

[57] ABSTRACT

A diazo microfilm which is resistant to fading upon exposure to strong light for extended periods of time is provided. The fade-resistant diazo microfilm is produced by saponifying a cellulose alkanoate film to an extent defined by certain infrared absorption parameters.

6 Claims, No Drawings

PROCESS OF MAKING AND USING FADE-RESISTANT DIAZO MICROFILM

This is a continuation of application Ser. No. 885,830, filed Mar. 13, 1978, now abandoned, which is a continuation of Ser. No. 724,357, filed Sept. 17, 1976, now abandoned.

BACKGROUND OF THE INVENTION

This invention relates to microfilm having improved properties. In one of its more particular aspects this invention relates to microfilm in which images contained on the microfilm are less susceptible to fading upon exposure to light than ordinary microfilm.

Diazo microfilm is typically made by applying a coating of, for example, 0.1 mil (2.5 microns) to 0.2 mil (5 microns) of a cellulose alkanoate to a polyester film base. This coating may incorporate light sensitive diazo chemicals or they may be impregnated into the layer from solvent solutions in a separate step. Such a product is then developed by application of an alkaline developer. Although microfilm prepared in accordance with this method is generally satisfactory, if exposed to radiation such as strong light in microfilm readers for extended periods of time, fading may occur with the result that in time the microfilm images may become illegible. For instance, as much as 90% of the image may be lost in a period of 16 hours exposure to the light from a microfilm reader.

Surface saponification of cellulose alkanoate films has been previously disclosed for the purpose of enhancing the substantivity of such films to photosensitive solutions. Dinaburg, for example teaches that the problems caused by non-uniform distribution of the photosensitive solution on the surface of the base layer of the film can be eliminated by coating the photosensitive solution onto the surface of cellulose which has previously been made hydrophilic by hydrolysis to a depth of 3–4 microns. (Dinaburg, M.S., *Photosensitive Diazo Compounds and Their Uses,* The Focal Press, London and New York). Other references teach superficial hydrolysis or deacylation, usually to a depth of approximately 4 microns. U.S. Pat. Nos. 1,340,416; 2,238,044; 3,311,475; 3,338,713; 3,397,058; 3,397,985; 3,442,651; and 3,442,652 contain such teachings. Dutch Patent application 72/07099 teaches surface hydrolysis to a depth of 5 microns. U.S. Pat. No. 3,365,293 teaches hydrolyzing a cellulose alkanoate to a depth of 5–10 microns.

None of the prior art, however, discloses controlled hydrolysis of a cellulose alkanoate layer to an extent defined by certain infrared absorption parameters to produce a fade-proof microfilm.

OBJECTS

It is accordingly a principal object of this invention to provide a microfilm which is substantially fade-proof.

Another object of this invention is to provide a process for producing diazo microfilm which is resistant to fading upon exposure to radiation.

Another object of this invention is to provide a means of controlling the process of production of such microfilm in order that the aforesaid advantages can be realized in a convenient manner.

Other objects and advantages of this invention will become apparent in the course of the following detailed disclosure and description.

SUMMARY OF THE INVENTION

The controlled saponification of cellulose ester films used in the production of diazo microfilms results in microfilms which, when developed exhibit a high degree of resistance to fading. Images produced upon development of such microfilms fade less than about 30% upon exposure to strong light for a period of about 16 hours. The extent of saponification is controlled by determining certain infrared absorption parameters of the partially saponified cellulose ester film which are directly related to the extent of saponification.

DESCRIPTION OF THE PREFERRED EMBODIMENTS

The method of controlling the saponification level of the cellulose ester layer used in producing the microfilm of this invention consists of using an infrared multiple internal reflectance band ratio method to determine the degree of surface saponification. The multiple internal reflectance band ratio method is effective in determining the chemical constitution of films at or near the surface thereof. This technique is readily adaptable for determining the depth of saponification and hence the saponification level of cellulose ester films. Other methods such as bulk analysis of the saponified films are cumbersome and difficult to use as a control method. The infrared technique of multiple internal reflectance using the ratio of two infrared absorption bands is uniquely satisfactory for this purpose. Since the saponification level of the film is directly related to certain readily measureable infrared absorptions, this method can be used as a convenient control method in microfilm production.

More particularly, the absorbance ratio R is determined where R is given by the equation $$R=(A_{5.8}-b/A_{6.1}-b$$

where $A_{5.8}$ and $A_{6.1}$ are the absorbance values at infrared absorption maxima near 5.8μ, and 6.1μ, the bands due to carbonyl absorption and molecular water, respectively, and b is a base-line correction taken by drawing a line tangent to the absorption minimum near 5.5μ, and parallel to the abscissa on a plot of infrared absorption against wavelength of infrared radiation.

Specifically, values for R of saponified cellulose acetate films and cellulose acetate propionate coatings on polyester films were found to produce desirable results with respect to fade resistance between the values of R=0.5 and R=1.5.

The diazo microfilm of this invention can be produced by applying a clear coating of a cellulose ester such as cellulose acetate, cellulose propionate, cellulose acetate propionate or cellulose butyrate to a polyester film and then saponifying the cellulose ester layer by treatment with a methanolic aqueous solution of potassium hydroxide, to provide the desired controlled level of saponification. The treatment of the film results in the hydrolysis of some of the ester groups to free hydroxyl groups which imparts a highly hydrophilic character to the resulting saponified film. Such saponified film will readily absorb aqueous solutions of diazo formulations. Similar treatment of unsupported cellulose acetate films can also be employed.

This invention will be better understood by reference to the following examples which are included for purposes of illustration and are not to be construed as limiting the scope of the instant invention which is defined in the claims appended hereto.

EXAMPLE 1

Cellulose diacetate film 5 mils thick was saponified with an aqueous methanolic solution of potassium hydroxide (80 cc. $H_2O$, KOH-7 gm., $CH_3OH$-20 cc.) by immersion for a period of 22 seconds at 90° F. followed by neutralization in a solution containing 100 cc water, 1.0 gm. sulfuric acid and thoroughly washing in water.

The saponified film was found to have an absorbance ratio, $$R=(A_{5.8}-b/A_{6.1}-b),$$

of 1.5

The saponified film was coated with a diazo stabilized solution of:

Water: 85 cc
Butyl Cellosolve: 10 cc
Citric Acid: 1.5 cc
Zinc Chloride: 1.5 gms
beta-oxynaphthoic monoethanolamide: 1.5 gms
2,5-diethoxy-4-morpholino-benzene diazonium chlorozincate: 1.5 gms
Saponin: 0.2 gm Coating to the saponified film was applied by the conventional air knife doctoring method.

Another coating containing the same coupler and diazo combination was applied to unsaponified cellulose diacetate to match the dye density of the coating applied to the saponified film. Coating formulation was:

Methyl Cellosolve: 60 cc
Methanol: 30 cc
Formic Acid: 4 cc
Water: 6 cc
Zinc Chloride: 0.5 gm
Citric Acid: 1.0 gm
Thiourea: 0.3 gm
Beta-oxynaphthoic monoethanolamide: 1.0 gm
2,5-diethoxy-4-morpholino-benzene diazonium chlorozincate: 1.5 gm Coating was applied to the unsaponified cellulose diacetate by the dip bead coating method.

Imaging of the films was made in a carbon arc and prints were ammonia developed in a Bruning 880 diazo printing machine having an anhydrous ammonia developing chamber.

Exposure of the resulting prints in a commercially available microfilm viewer (IBM-IIB viewer) for a period of about 16 hrs. resulted in a 3% fade compared to an 85% fade in the case of the unsaponified film.

EXAMPLE 2

The procedure of Example 1 was followed except that N-(3-morpholino-1-propyl)-3-hydroxy-2-naphthylamide was used as the coupler instead of beta-oxynaphthoic monoethanolamide. The percent fade of the unsaponified film was found to be 52% compared to 0.5% for the saponified film.

EXAMPLE 3

The procedure of Example 1 was repeated except that resorcinol was used as the coupler. The percent fade of the unsaponified film was found to be 18% compared to 0.5% for the saponified film.

EXAMPLE 4

The procedure of Example 1 was repeated except that acetoacetanilide was used as the coupler. The percent fade of the unsaponified film was found to be 57% compared to 12% for the saponified film.

EXAMPLE 5

The procedure of Example 1 was followed except that p-diazodiethyl aniline zinc chloride was used as the diazonium salt instead of 2,5-diethoxy-4-morpholino-benzene diazonium chlorozincate. The percent fade of the unsaponified film was found to be 95% after exposure over a weekend compared to 3% for the saponified film.

EXAMPLE 6

The procedure of Example 1 was followed except that p-diazodiethylaniline zinc chloride was used as the diazonium salt and N-(3-morpholino-1-propyl)-3-hydroxy-2-napthylamide was used as the coupler. The percent fade of the unsaponified film was found to be 75% compared to 11% for the saponified film.

EXAMPLE 7

The procedure of Example 1 was followed except that p-diazodiethylaniline zinc chloride was used as the diazonium salt and resorcinol was used as the coupler. The percent fade of the unsaponified film was found to be 24% compared to 0.4% for the saponified film.

EXAMPLE 8

The procedure of Example 1 was followed except that p-diazodiethylaniline zinc chloride was used as the diazonium salt and acetoacetanilide was used as the coupler. The percent fade of the unsaponified film was found to be 67% compared to 0.5% for the saponified film.

EXAMPLE 9

A coating to polyester (5 mil ICI-505 grade) for the purpose of saponification was prepared as follows:

Sub Coat Formula:
Methyl Ethyl Ketone: 80 cc
Methyl Cellosolve: 20 cc
Alcohol Soluble Cellulose Acetate Propionate: 275 gm (Eastman Kodak)

The acetate solution was applied to the polyester film by a wire bar (#65) coating method, to a dry thickness of a minimum 0.5 mil. The lacquered film was saponified with KOH solution as described in Example 1 but varying immersion time to obtain R values of 1.8, 1.3, 1.05 and 0.85. The lacquered film unsaponified provided an R value of 2.10. The various R value films were diazo sensitized, exposed and ammonia developed as described in Example 1.

All of the R valued diazo sensitized films were exposed to 16 hrs. in a lighted IBM-IIB reader and percent fade recorded.

R-2.10=95% reader fade
R-1.80=68% reader fade
R-1.30=24% reader fade
R-1.05=15% reader fade
R-0.85=5% reader fade This invention has been described with reference to certain specific embodiments and to various suggested conditions of operation. However, other embodiments can be utilized in the practice of this invention. It is therefore intended that this invention is not to be limited except as defined in the following claims.

I claim:

1. A process comprising reproducing images on diazo microfilm that includes a partially saponified cellulose ester film and a two-component light-sensitive diazo composition comprising an acid stabilized combination of a photosensitive diazonium compound and an azo coupler in the partially saponified cellulose ester, the saponification being sufficient to limit fading of the reproduced images to less than about 30% upon exposure of said images to strong light for a period of about 16 hours, said process including exposing said microfilm to a light image, developing said image with an alkaline developer, and exposing the developed image to said strong light in a microfilm reader.

2. The process of claim 1 wherein said cellulose ester is a cellulose alkanoate.

3. The process according to claim 1 wherein the cellulose ester is cellulose diacetate.

4. The process according to claim 1 wherein the cellulose ester is cellulose acetate-propionate.

5. The process of claim 1 wherein the thickness of the cellulose ester film is at least about 0.5 mil and is adhered to a polyester base.

6. The process of claim 1 wherein the thickness of the cellulose ester is about 5 microns.

* * * * *